United States Patent [19]

Roberts

[11] 4,455,894

[45] Jun. 26, 1984

[54] HAND HELD OPENING APPARATUS

[76] Inventor: Richard D. Roberts, 157 Kenwood St., Elyria, Ohio 44035

[21] Appl. No.: 511,098

[22] Filed: Jul. 6, 1983

Related U.S. Application Data

[63] Continuation-in-part of Ser. No. 440,008, Nov. 8, 1982, abandoned.

[51] Int. Cl.[3] ..... B67B 7/44; B67B 7/40; B67B 7/18; B67B 7/30

[52] U.S. Cl. ..... 81/3.1 R; 81/3.46 R; 81/3.4; 7/151; 30/317; 30/DIG. 3; D8/33

[58] Field of Search ..... 81/3.1 R, 3.34, 3.4, 81/3.46 R; D8/33, 34, 40, 41, 43, 105; 30/DIG. 3; 7/151, 901

[56] References Cited

U.S. PATENT DOCUMENTS

| | | | |
|---|---|---|---|
| D. 215,807 | 11/1969 | Weingardt | D8/2 |
| D. 238,411 | 1/1976 | Levenson | D8/18 |
| D. 258,041 | 1/1981 | Anderson | D7/99 |
| D. 263,551 | 3/1982 | Dale | D8/40 |
| D. 267,925 | 2/1983 | Mancusa | D8/40 |
| 1,681,749 | 8/1928 | Smith . | |
| 1,696,920 | 1/1929 | Miller . | |
| 2,641,397 | 6/1953 | Sander . | |
| 2,641,793 | 6/1953 | Wilm | 7/901 |
| 2,810,194 | 10/1957 | Unsinger | 30/317 |
| 3,736,817 | 6/1973 | Huff | 81/3.1 C |
| 3,812,741 | 5/1974 | Heine | 81/3.4 |
| 4,133,228 | 1/1979 | DePooter | 81/3.1 R |
| 4,391,167 | 7/1983 | Bergmeister | 81/3.46 R |

FOREIGN PATENT DOCUMENTS

| | | | |
|---|---|---|---|
| 2622541 | 12/1977 | Fed. Rep. of Germany | 81/3.1 R |
| 1136119 | 12/1956 | France | 7/901 |
| 44336 | 9/1938 | Netherlands | 81/3.34 |
| 614825 | 12/1948 | United Kingdom | 30/1.5 |

*Primary Examiner*—Roscoe V. Parker
*Attorney, Agent, or Firm*—Richard P. Matthews

[57] ABSTRACT

A hand held opening apparatus with no moving parts which includes three distinctly different opening devices. One of the opening devices consists of a centrally located socket-like portion at the center of a substantially flat body portion. This opening device is adapted to be telescoped over twist-off bottle cap members. A second opening device is located at one end of the flat body portion and consists of a wedge member insertable beneath a ring pull tab of a can end easy opening member. The third opening device is used to open plastic bags or the like and consists of a blade laminated within upper and lower portions of the flat body portion at the end opposite the second opening device. The body portion may be made from a plastic material and a permanent magnet may be embedded in one surface of the flat body member to permit the apparatus to be held magnetically when not in use.

4 Claims, 14 Drawing Figures

HAND HELD OPENING APPARATUS

This invention is a continuation-in-part of Ser. No. 440,008, filed Nov. 8, 1982 and now abandoned.

This invention relates to a hand held opening apparatus and, more particularly, to such an apparatus which is capable of opening a plurality of different types of articles or containers.

Heretofore it has been known to manufacture a number of hand held opening devices with no moving parts, but none have provided adequate opening devices for both twist-off bottle tops and plastic bags as well as an opening assist for easy open can ends. Moreover, the known prior art fails to disclose a socket-like hand held member for use in opening twist-off bottle tops with handle means extending from the socket portion. Consequently, it also fails to show the substitution of opening devices for the pair of oppositely extending handle portions. In particular, the provision of a bag opening device which comprises one handle portion for a socket-like twist-off bottle opener appears to be lacking in known prior art devices.

The foregoing limitations and shortcomings of the known prior art are effectively overcome in accordance with the present invention which provides a multiple opening device which may be easily carried or conveniently held on a ferrous material such as on a refrigerator door. It is preferred to have a socket-like twist-off bottle cap opener located centrally between a pop top or easy open can end opener assisting means on one end and a bag opening means at the other end so that the can end opener and the bag opener provide radially opposed handle means for the bottle cap opener. With respect to each end located opening device, the other two opening devices serve as a handle.

The socket-like twist-off bottle cap opener is provided with a plurality of preferably evenly spaced lug members which tape inwardly toward the center of the socket. The lug members themselves extend transversely to the longitudinal axis of the opening device from substantially one surface of the flat body portion of the opening device to the opposite surface thereof. It is preferred to use stop means to limit the depth to which the socket portion can be telescoped over a twist-off bottle cap.

In the bag opening device located at one end of the flat body portion of the hand held opening apparatus, a blade is carried between the upper and lower surfaces of the flat body portion in laminated fashion. Slot means which extend inwardly from a side edge of the flat body to a location slightly past the cutting edge of the blade permits the device to be used in opening plastic bags such as those that are heat sealed to contain potato chips or the like.

The opening device for a pop top or easy opening can end includes a wedge shaped member which is held at an angle of about 45 degrees to the plane of the can end and inserted beneath a ring pull tab. The wedge-shaped member is provided with an undercut portion that engages the hemmed or rolled over edge of the pull tab. The user's finger is then placed on the outside of the pull tab and the tab is then rotated about the riveted connection to the can end to effect opening of the can end.

The inherent advantages and improvements of the opening apparatus of the present invention will become more readily apparent by reference to the following detailed description of the invention and by reference to the drawings wherein.

Figure 1:
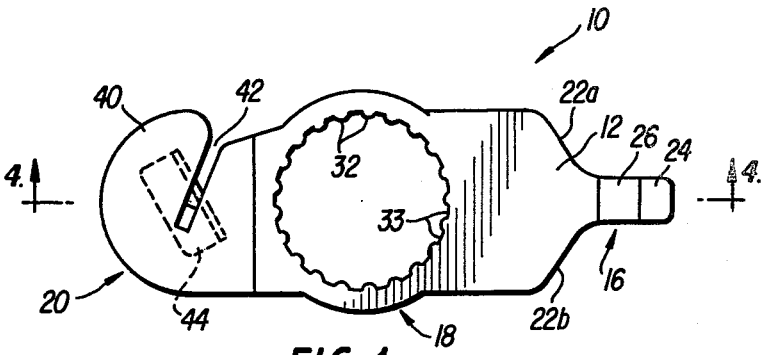
FIG. 1 is a top plan view of the opening apparatus of the present invention.
Figure 2:
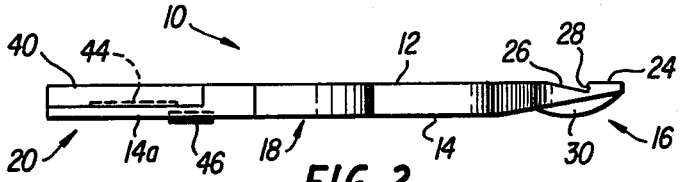
FIG. 2 is a front elevational view of the apparatus of FIG. 1.
Figure 3:
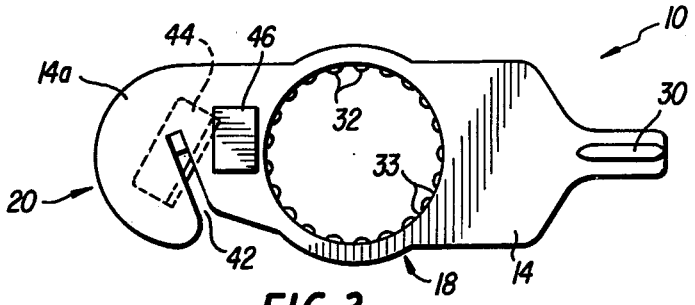
FIG. 3 is a bottom plan view of the apparatus of FIG. 1.

Referring now to FIG. 1 of the drawings, there is illustrated a hand held opening apparatus or tool indicated generally at 10. Tool 10 has an upper surface constituting a flat body portion 12 and a lower surface 14 providing a flat body portion as illustrated in FIGS. 2 and 3. The right hand end of tool 10, as viewed in FIGS. 1 through 4, constitutes a pop top assist opening device indicated generally at 16. A centrally located twist off bottle cap remover is designated generally at 18 and has a centrally located socket portion while the left hand end of tool 10 comprises a bag slitter indicated generally at 20.

Figure 4:
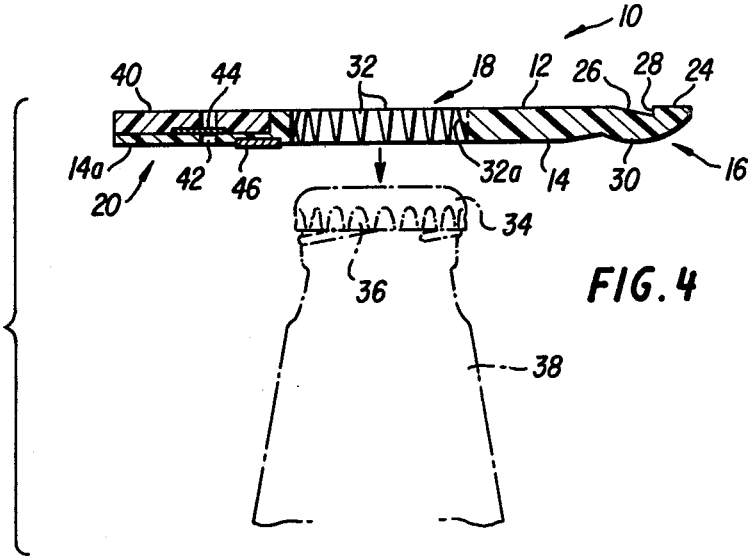
FIG. 4 is an elevational view taken in vertical cross section along line 4—4 of FIG. 1 with a fragmentary phantom representation of a twist-off bottle cap and bottle.

The body portion defined between upper and lower surfaces 12, 14 as seen in the plan view of FIG. 1 tapers inwardly at *22a*, *22b* forming a narrow peninsula-like end terminating in a hook-like end 24. This hook 24 as seen best in FIGS. 2 and 4 is defined by a downwardly sloping portion 26 from the upper surface 12 terminating in a vertical edge 28. The underside of the peninsula-like end is provided with a curved lug or protrusion 30.

Figure 5:
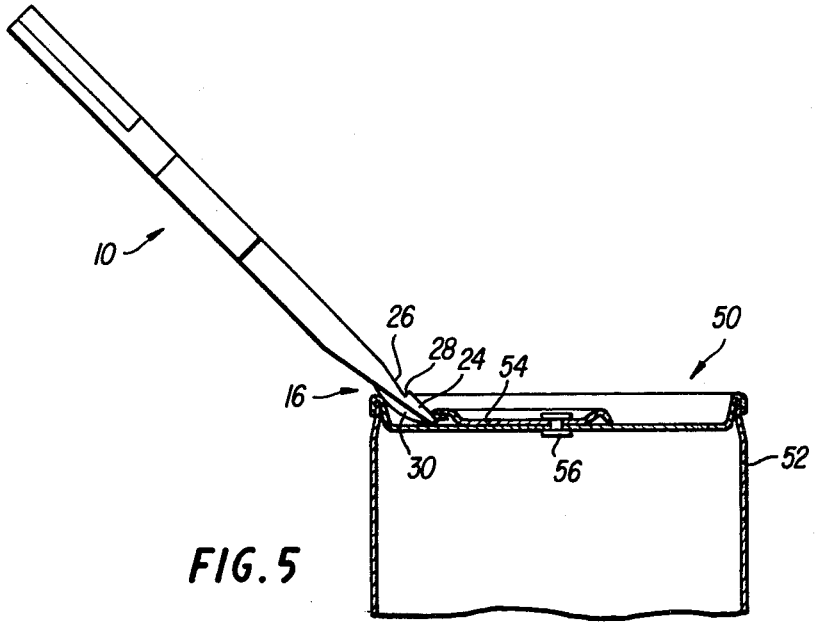
FIG. 5 is an elevational view of the opening apparatus of FIG. 1 with an easy opening can end and can shown in vertical cross section.
Figure 6:
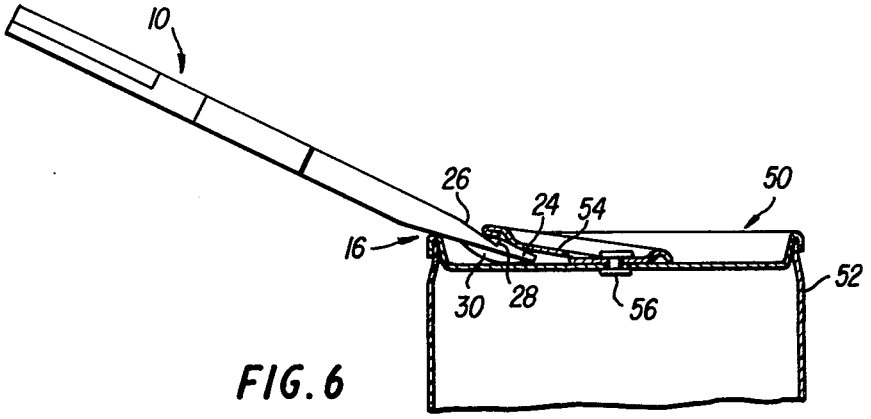
FIG. 6 is an elevational view of the opening apparatus and easy open can in vertical cross section as shown in FIG. 5 but illustrating another position.
Figure 7:
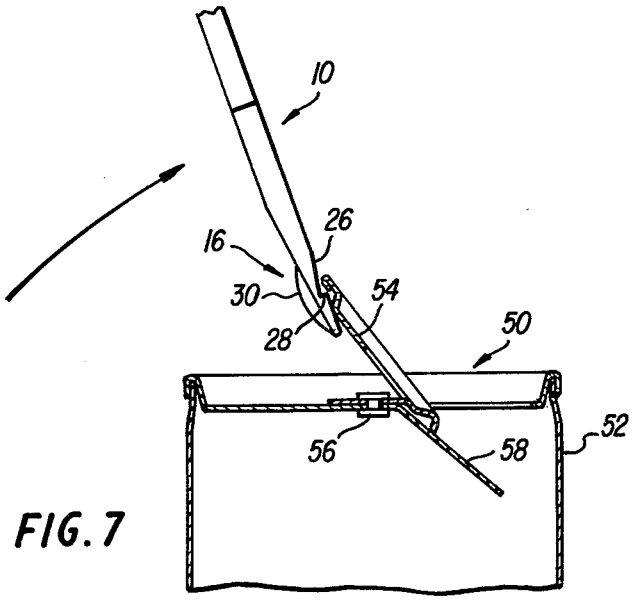
FIG. 7 is a side elevational view of the opening apparatus and easy open can in vertical cross section as shown in FIG. 5 but illustrating still another position.

The operation of the pop top assist 16 is demonstrated in FIGS. 5 through 7. In FIG. 5 the peninsula-like end is being inserted beneath a pull tab 54 of an easy open end device indicated generally at 50. A can body wall is shown at 52 and the pull tab 54 is attached to the can end with a conventional rivet-like connection 56. In FIG. 6 the device is further inserted beneath the pull tab so that the hook may clear any rolled or hemmed edge portion on the pull tab 54, thereby making the pull tab accessible and more easily lifted. In use the thumb or forefinger of the user may be placed atop the pull tab 54 and the pull tab rotated in a clockwise direction as illustrated in FIG. 7 so as to force a scored and thereby weakened area 58 out of the plane of the can end providing a pouring or drinking aperture in the can end. The hook 24 may engage the rolled or hemmed edge portion of the pull tab 54 to prevent the tool 10 from slipping out from beneath the pull tab as the tool 10 is rotated.

It should be noted in connection with the foregoing that the curved leg or protrusion 30 forms a generally wedged-shaped or tapering portion at the end of the pop top assist device 16 thereby facilitating the lifting of the pull tab and rupture of the weakened scored portion. Also, as the peninsula-like end is inserted beneath the pull tab, the remainder of the tool 10 including the twist off bottle cap remover 18 and bag slitter 20 constitutes a handle for the user.

The twist off bottle cap remover 18 comprises a centrally located socket portion with a centrally located aperture between the upper and lower surfaces 12, 14 of the hand held opening apparatus 10. A plurality of tapering lug members 32 are provided with the taper illustrated at **32*a* in FIG. 4 as the lug members extend from the upper surface 12 to the lower surface 14. A plurality of spaces 33 are provided between the lug members whereby the lug members 32 will interengage with pleats 36 in a lower skirt portion of a twist off bottle cap 34 attached to a bottle 38 all as shown in FIG. 4. The twist off bottle cap remover portion 18 moves in the direction of the arrow in FIG. 4 to interengage the lug members 32 of the pleated skirt portion 36 of the twist off bottle cap 34 whereby the bottle cap may be removed with a twist off motion. It is possible to utilize lug members 32 which do not taper by a proper selection of the depth of the body wall of the opening device 10. Also it will be noted that the pop top assist opening device 16 and the bag opener 20 constitute radially opposed handle means when using the twist off bottle cap remover 18**.

Reference is also made to FIG. 4 for an illustration of the bag slitter opening device 20 which includes an upper laminated portion 40 above a lower laminated portion **14*a*. In the device illustrated 14*a* constitutes an extension of the main body of the opening apparatus 10 and of the lower surface 14. The body of the opening apparatus 10 is provided with a slot 42 which extends through the upper laminated portion 40 and lower laminated portion 14*a* so as to extend beyond the leading edge of a blade 44 that is retained between upper laminated portions 40 and the lower portion 44*a***.

In the use of the bag slitter opening device 20, the top of the bag to be slit is inserted into slot 42 until it engages the cutting edge of blade 44. The blade cuts through the edge laminated front and rear panels of the bag with the twist off bottle remover portion 18 and the pop top assist opening device 16 providing a handle for the user of tool 10.

If desired, a permanent magnet 46 may be inserted into either the upper or lower surface of the opening apparatus 10 so that the device may be magnetically held to a ferrous object such as a refrigerator.

Figure 8:
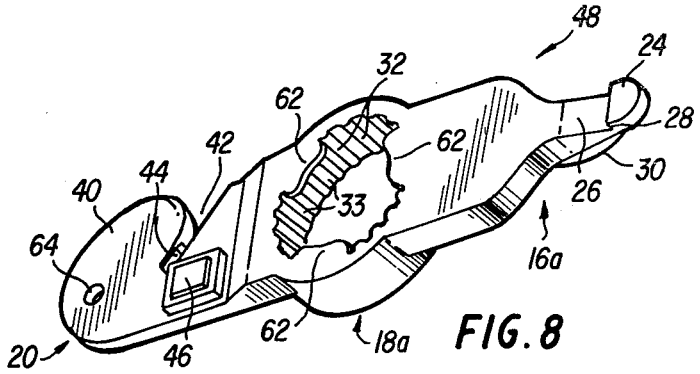
FIG. 8 is a perspective view of another embodiment of the present invention.

FIG. 8 illustrates a modified form of an opening apparatus indicated generally at 48 wherein a stop means is employed to limit the depth to which the socket portion **18*a* can be telescoped over a twist-off bottle cap. In this form of the invention, the stop means takes the form of a plurality of tab members 62 which extend radially inwardly of the socket portion 18*a* a greater distance than the outstanding lug members 32 extend inwardly. The remaining features of this opening device 48 are the same as in FIGS. 1 through 7. Thus, there is a pop-top assist, indicated generally at 16, and the bag slitter, indicated generally at 20, although the latter includes an optional eyelet 64** in order to hang the device from a nail on the wall or the like.

Figure 9:
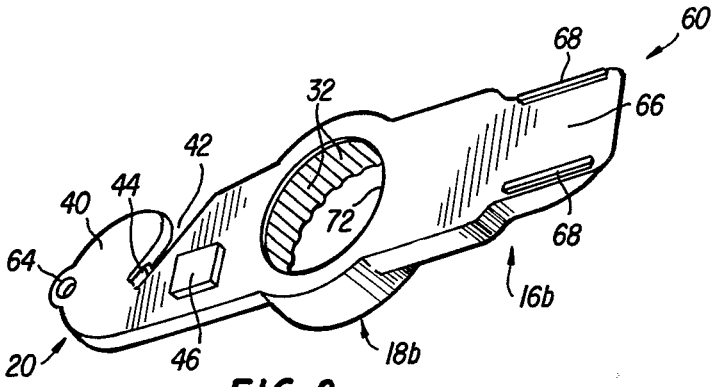
FIG. 9 is a perspective view of a further embodiment of the present invention.
Figure 10:
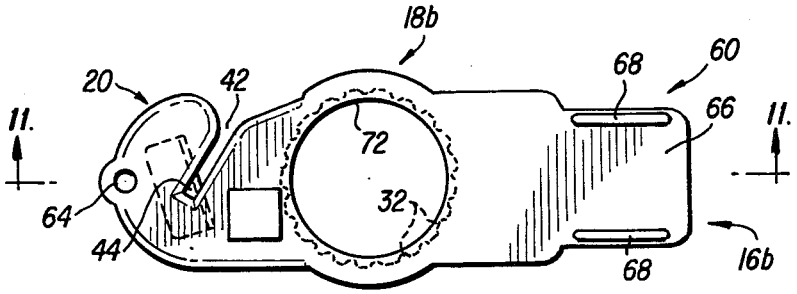
FIG. 10 is a top plan view of the embodiment of FIG. 9.
Figure 11:
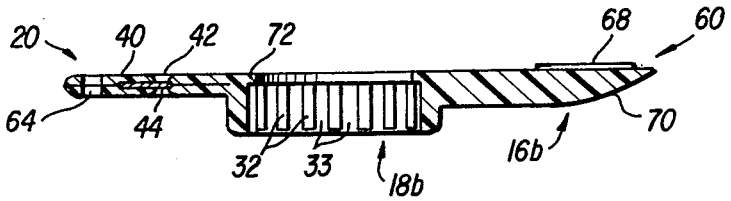
FIG. 11 is an elevational view taken in vertical cross section along line 11—11 of FIG. 10.
Figure 12:
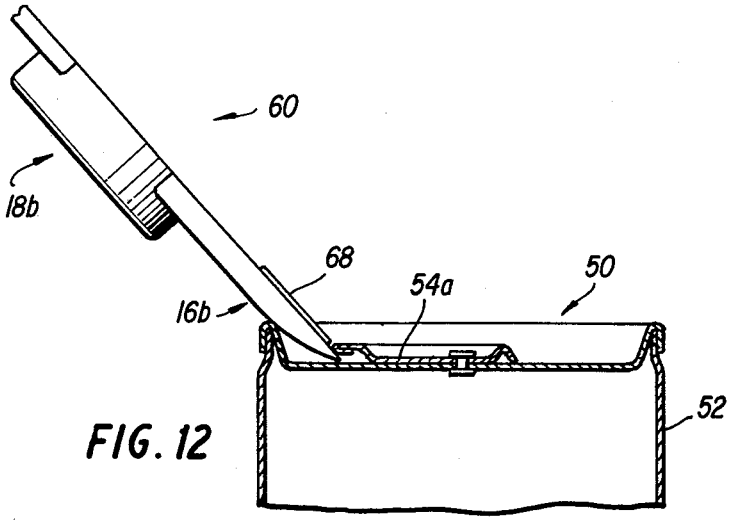
FIG. 12 is an elevational view of the opening apparatus of FIG. 9 with an easy opening can end and can shown in vertical cross section.
Figure 13:
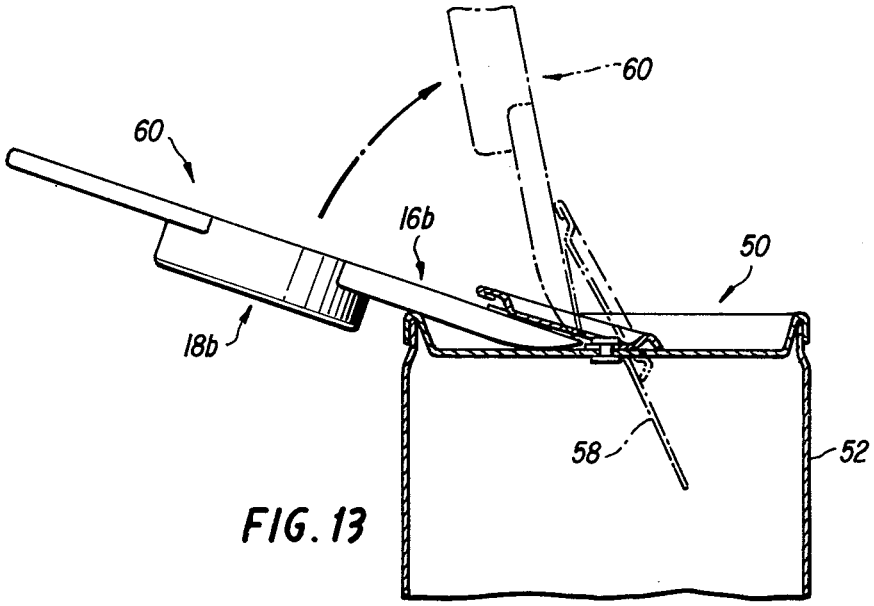
FIG. 13 is an elevational view similar to FIG. 12 but illustrating two subsequent positions.
Figure 14:
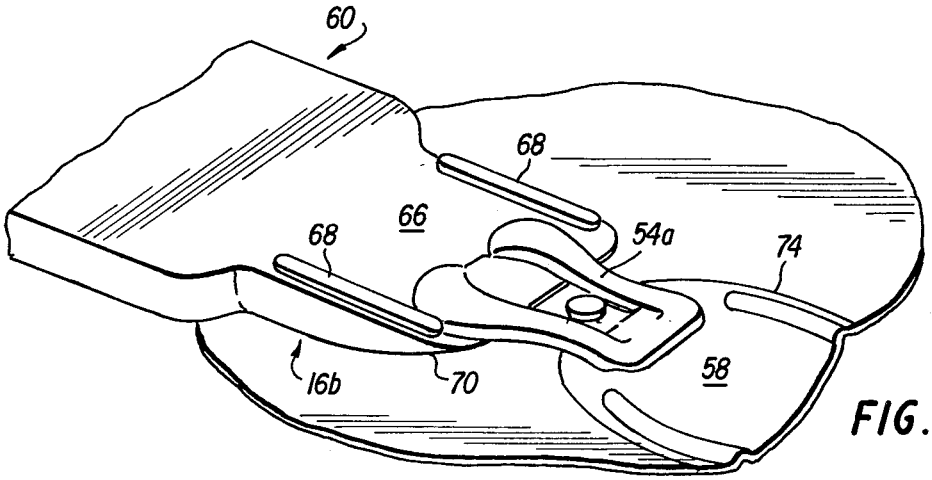
FIG. 14 is a fragmentary perspective view of the opener of FIG. 9 as it is being inserted under the pull tab of FIG. 12 drawn to an enlarged scale.

A preferred embodiment of the invention is illustrated in FIG. 9 wherein the hand held opening apparatus is indicated generally at 60. In this form of the invention, a pop-top assist is indicated generally at **16*b* and is intended to be used in connection with easy open containers wherein the opening device remains attached to the easy open can end. The pull tab of FIGS. 1 through 7 is the so-called ring tab which is completely severed from the can end but this construction is now banned in the great majority of states in the United States. As shown in FIGS. 9 through 11, the opening apparatus 60 comprises a flat body portion having a substantially flat upper surface 66 on one end of the opening apparatus. In order to contain the pull tab such as is shown at 54*a* in FIGS. 12 through 14 and to prevent the opening apparatus 60 from slipping laterally out from under the tab, the apparatus 60 is provided with a pair of raised longitudinally extending guide members 68 on the flat upper surface 66. The pop top assist opening device 16*b* also has a wedge-shaped under surface 70, seen best in FIG. 11. This wedge-shaped surface 70 is insertable beneath the pull tab 54*a* of FIGS. 12 through 14 and advanced forwardly substantially to the rivet attachment of the pull tab 54*a* to the easy open can end 50. When fully inserted, the hand held opening apparatus 60 is pivotally rotated as indicated by the arrow in FIG. 13 causing the weakened area 58 within the scored or weakened area 74 to pivot downwardly as is also illustrated in FIG. 13. As seen in FIG. 14, the guide members 68 are spaced apart a distance slightly greater than the width of the tab 54*a* so that the tab may be contained within the upstanding portions of the guide members 68 so that the opening device 60 will not slip laterally out from under tab 54*a***.

FIGS. 9 through 13 also illustrate a preferred embodiment of the twist-off bottle cap remover **18*b*. In this form of the invention, the socket is provided with an overhanging peripherally extending shoulder or ledge 72 which constitutes stop means to limit the depth to which the socket portion can be telescoped over a twist-off bottle cap. In order to do this, the radial inward or overhanging portion of the shoulder or ledge 72 is slightly greater than the distance that the inwardly projecting lug members 32 extend from the socket member 18*b*. The optional use of either an eyelet 64 or a permanent magnet 44** to hang the opening apparatus up is illustrated in these figures.

While a presently preferred embodiment of the invention has been illustrated and described, it will be recognized that the invention may be otherwise variously embodied and practiced within the scope of the claims which follow.

I claim:

1. A hand held opening apparatus for a plurality of different containers consisting of a. a flat, substantially solid plastic member having substantially flat upper and lower surfaces throughout its length, b. a pop top can opening device located at one end of said flat plastic member, said pop top can opening device consisting of (1) a bevelled surface extending from one end of said flat upper surface to said lower surface providing a wedge-shaped end adapted to be inserted beneath a pull tab of a pop top can, said bevelled surface further extending completely across said flat plastic member, (2) a pair of laterally-spaced and longitudinally extending rib members extending upwardly from said flat upper surface, (a) said rib members being spaced laterally a distance slightly greater than the width of said pull tab and serving as guide means to retain said pop top opening device beneath said pull tab, c. and a twist-off bottle cap opening device centrally located with respect to said flat plastic member, said twist-off bottle cap opening device consisting of (1) a centrally located portion of said flat, substantially solid plastic member having a hollow hub member extending from said upper surface to a location beneath said lower surface of said plastic member and adapted to be telescoped over a twist-off bottle cap to be opened, (a) said hollow hub member having a plurality of radially inwardly extending lug members each extending for substantially the full length of said hollow hub member, (b) and radially inwardly extending overhanging means in line with said upper surface, said overhanging means extending radially inwardly a distance greater than said lug members, said overhanging means serving to limit the depth to which said bottle cap opener may be telescoped over said twist-off bottle cap.

2. A hand held opening apparatus as defined in claim 1 wherein said means to limit the depth to which said socket portion can be telescoped over said twist-off bottle cap consists of a plurality of tab members which extend radially inwardly of said socket portion a greater distance than said upstanding lug members.

3. A hand held opening apparatus as defined in claim 1 wherein said means to limit the depth to which said socket portion can be telescoped over said twist-off bottle cap consists of an overhanging ledge which extends peripherally around said socket portion and extends radially inwardly therefrom a distance greater than the inward projection of said upstanding lug members.

4. A hand held opening apparatus as defined in claim 2 including a blade member carried within and parallel to the upper and lower surface of said flat plastic member at the end opposite said wedge-shaped end of said opening apparatus and further includes slot means extending inwardly from a side edge of said flat plastic member to a location slightly past a cutting edge of said blade member.

* * * * *